US005232155A

United States Patent [19]

Chen

[11] Patent Number: 5,232,155

[45] Date of Patent: Aug. 3, 1993

[54] INTEGRITY SENSOR FOR FLUID JET NOZZLE

[75] Inventor: Wei-Long Chen, Singapore, Taiwan

[73] Assignee: Ingersoll-Rand Company, Woodcliff Lake, N.J.

[21] Appl. No.: 902,523

[22] Filed: Jun. 22, 1992

Related U.S. Application Data

[63] Continuation-in-part of Ser. No. 701,997, May 17, 1991, abandoned.

[51] Int. Cl.[5] ..... B05B 17/00

[52] U.S. Cl. ..... 239/71; 51/415

[58] Field of Search ..... 239/71, 590-590.5; 73/861.52, 197; 340/606, 608, 610, 611; 118/688, 692; 51/415, 438, 439

[56] References Cited

U.S. PATENT DOCUMENTS

| | | | |
|---|---|---|---|
| 2,520,566 | 8/1950 | Sargrove | 51/14 |
| 4,430,886 | 2/1984 | Rood | 239/71 |
| 4,833,748 | 5/1989 | Zimmer et al. | 239/71 |
| 4,873,855 | 10/1989 | Thompson | 51/415 |
| 4,917,296 | 4/1990 | Konieczynski | 239/71 |
| 4,922,852 | 5/1990 | Price | 239/71 |
| 4,977,517 | 12/1990 | Gibbs, Jr. et al. | 340/608 |
| 5,018,670 | 5/1991 | Chalmers | 51/439 |

FOREIGN PATENT DOCUMENTS

| | | | |
|---|---|---|---|
| 0159977 | 10/1985 | European Pat. Off. . | |
| 801775 | 2/1981 | U.S.S.R. | 239/71 |

*Primary Examiner*—Andres Kashnikow
*Assistant Examiner*—Lesley D. Morris
*Attorney, Agent, or Firm*—Walter C. Vliet; Glenn B. Foster

[57] ABSTRACT

An apparatus includes a nozzle assembly having a nozzle orifice formed therein. A highly pressurized fluid source is in fluid communication with the nozzle orifice, wherein a fluid jet is discharged through the nozzle orifice into a chamber downstream of said nozzle assembly which contains entrained air. A sensor is in fluid communication with the chamber for sensing the fluid condition of the entrained air in said chamber which provides an indication of the quality of the nozzle orifice. An alignment portion aligns the orientation of the fluid jet relative to the workpiece based upon the indication of the quality of the fluid jet.

17 Claims, 2 Drawing Sheets

INTEGRITY SENSOR FOR FLUID JET NOZZLE

This is a continuation-in-part of application Ser. No. 07/701,997, filed on May 17, 1991 now abandoned.

BACKGROUND OF THE INVENTION

This invention relates generally to fluid jet nozzles and more particularly to a flow sensor located in a chamber downstream of the orifice to sense the flow characteristics of the fluid jet, and the condition of the nozzle orifice.

In fluid jet cutters and cleaners, the condition of the nozzle assembly makes a considerable difference in the quality of fluid jet being produced. The more coherent the stream, in general, the more effective and efficient will be the cutting ability of the stream.

Previously, many different ways were used to monitor the condition of the nozzle. These include visual inspection of the fluid jet stream, measuring the vibrational frequency of the fluid jet, monitoring the noise produced by the fluid jet and measuring the dimensions of the cut and surface finish of the surface cut left by the fluid jet. These methods are often imprecise, expensive or left open to operator skill and opinion.

Other ways to monitor the condition of the nozzle include direct inspection of the nozzle orifice and measuring the weight of the nozzle structure. In order to implement the these systems, the fluid jet has to be stopped and the nozzle removed. Also, considerable damage can be done to the parts being cut prior to discovery of the defective orifice.

Abrasive fluid jet cutters and cleaners are an especially difficult to monitor since the flow characteristics of the fluid jet downstream of the funnel tube can be affected not only by the condition of the orifice and specifics of the fluid jet adjacent the orifice, but also by the configuration and dimensions of the chamber and funnel tube and the type and amount of abrasives being used. Monitoring whether the fluid jet is within permissible limits and causes of the flow abnormalities in the fluid jet is therefore difficult.

The foregoing illustrates limitations known to exist in present fluid jet cutter and cleaning systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus which includes a nozzle assembly having a nozzle orifice formed therein. A highly pressurized fluid source is in fluid communication with the nozzle orifice, wherein a fluid jet is discharged through the nozzle orifice into a chamber downstream of said nozzle assembly, the chamber containing entrained air. A sensor is in fluid communication with the chamber for sensing the fluid condition of the entrained in said chamber which provides an indication of the quality of the nozzle orifice.

The foregoing and other aspects will become apparent from the following detailed description of the invention when considered in conjunction with the accompanying drawing figures.

BRIEF DESCRIPTION OF THE DRAWING FIGURES

Figure 3:
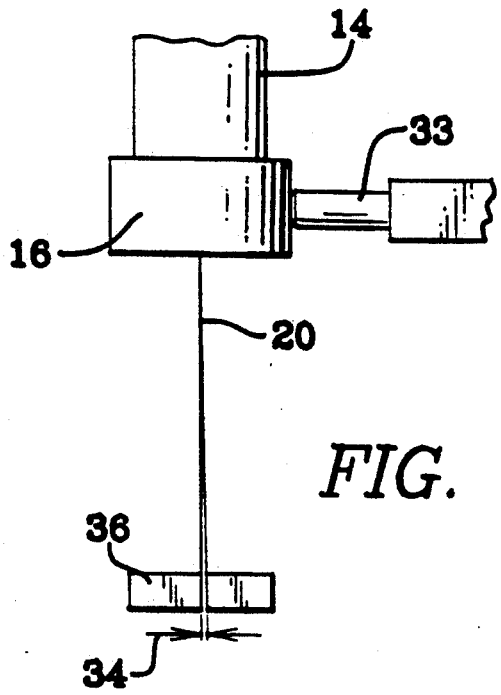
Figure 4:
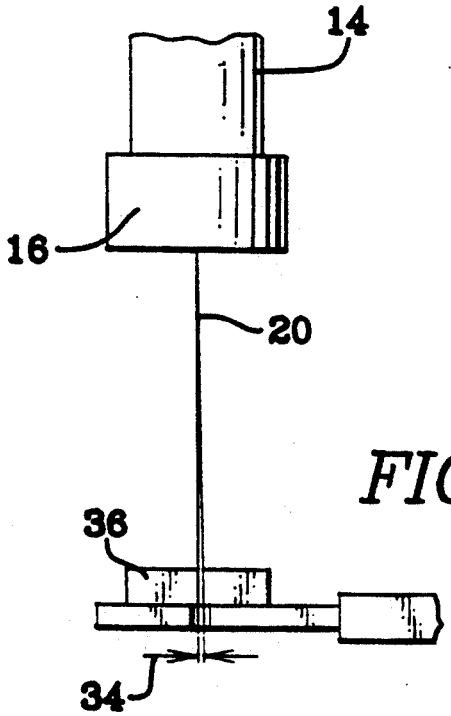

FIG. 3 is a side elevational view illustrating yet another alternate embodiment of fluid jet nozzle apparatus with sensor, including alignment means to align, the position of the fluid jet nozzle apparatus relative to the workpiece; and FIG. 4 is a side elevational view illustrating a final embodiment of fluid jet nozzle apparatus with sensor, including alignment means to align the position of the workpiece relative to the fluid jet nozzle apparatus.

DETAILED DESCRIPTION

Figure 1:
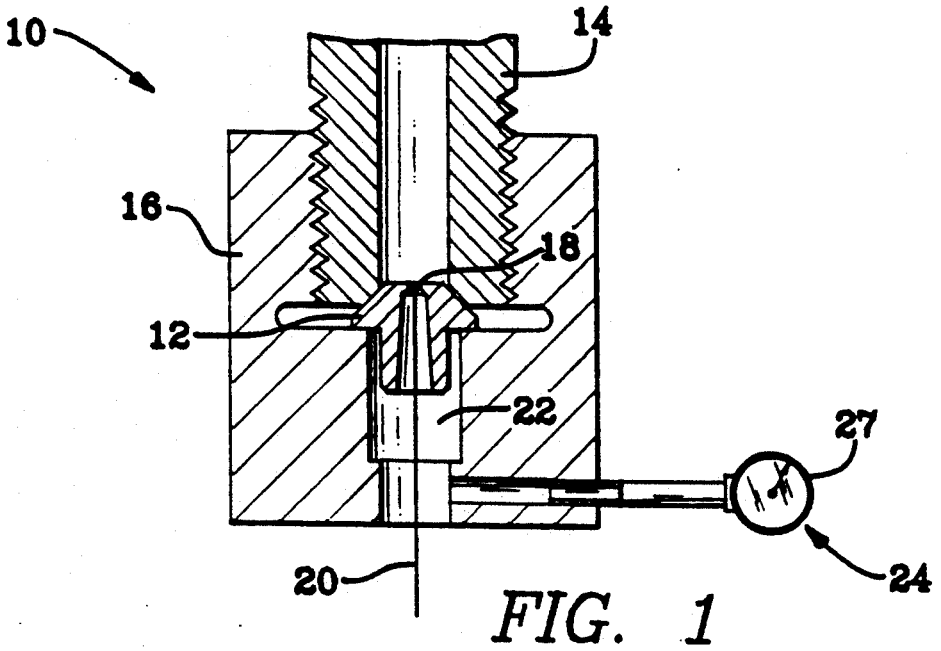
FIG. 1 is side cross sectional view illustrating an embodiment of non-abrasive fluid jet nozzle apparatus including a sensor of the present invention.

In this disclosure, elements from different embodiments which perform identical functions will be provided with identical reference characters. FIG. 1 illustrates a fluid jet nozzle apparatus 10. The fluid jet nozzle apparatus 10 includes a nozzle assembly 12, a nozzle tube 14 and a nozzle nut 16. The nozzle assembly 12 has a nozzle orifice 18 formed therein as is well known in the art. Nozzle assemblies of this type may be used in fluid jet cutting, cleaning or milling operations.

The nozzle tube 14 contains fluid which is under pressure and is in fluid communication with the nozzle orifice 18, wherein a fluid jet 20 is produced downstream of the nozzle assembly 12 into a chamber 22. A sensor 24 is in fluid communication with the chamber 22.

The sensor 24 senses the fluid pressure or flow rate of entrained air (which is the air entrained and contained within the chamber which the fluid jet 20 is discharged into—and may include abrasives or other impurities which assist in the cutting or other processes). Fluid jet 20 exiting from a defective nozzle will be more dispersed within the chamber than a fluid jet exiting, under similar conditions, from an acceptable nozzle. This dispersion of fluid will produce an increased turbulence of the entrained air, resulting in an altered pressure and/or flow rate of the entrained air. This increased turbulent condition relates not only the fluid pressure of the entrained air, but also affects the flow rate of the entrained air as well. The flow rate and/or fluid pressure of entrained air can be sensed by the sensor 24 which may be either a fluid pressure sensor or flowmeter in fluid communication with the chamber.

Many factors affect the shape and properties of the fluid jet 20. These factors include the condition and configuration of the nozzle orifice 18, as well as fluid pressure applied within the nozzle tube 14. The cutting effectiveness and precision of the cut are affected by the condition of the fluid jet 20. Therefore it is highly desirable to continually monitor the condition of the fluid jet 20 in fluid jet cutting, milling, and cleaning applications.

Figure 2:
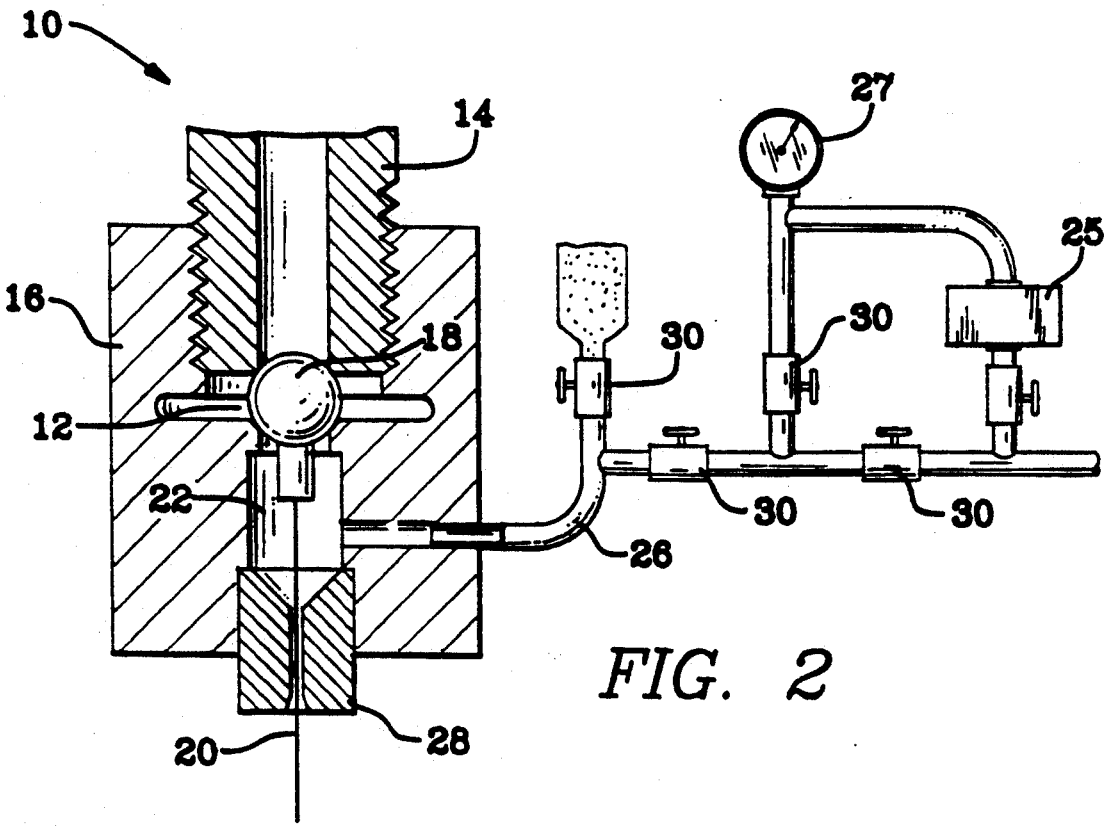
FIG. 2 is a side cross sectional view illustrating an alternate embodiment of abrasive fluid jet nozzle apparatus including a plurality of sensors of the present invention.

Either a flow meter or a pressure sensor may be used as a sensor 24 in the present application. Both types of sensors provide reliable indication of the condition of the fluid jet 20 by sensing the entrained air, as described above. It may be desired to provide both a pressure sensor 27 and a flow meter 25, as illustrated in FIG. 2. In situations where the sensor is monitored by a computer, an acceptable value for the pressure indicated by the pressure sensor 27 can be within a preset range for a specified range indicated by the flow meter 25, or vice versa.

Sensors of this type may be applied to either non-abrasive fluid jet cutting applications, as illustrated in FIG. 1, or to abrasive fluid jet cutting applications as illustrated in FIG. 2. In FIG. 2, an abrasive inlet means 26 is in fluid communication with the chamber 22. A focusing tube 28 is located downstream of the chamber 22, and is substantially coaxial with the fluid jet 20. One or more control valves 30 may be applied to control the fluid flow from abrasive inlet means 26 or sensor 25, 27. Using the control valves 30, the sensor 24 and the abrasive inlet means 26 may be applied as desired.

For abrasive fluid jet cutting applications, there exists an optimum abrasive feeding rate which depends upon the operational parameters of the fluid jet cutter (the relevant parameters include the size of the nozzle orifice 18, the size of the focusing tube 28, the fluid pressure and the type and size of abrasives added to the fluid.

All of the above parameters remain unchanged during most cutting applications except the size of the nozzle orifice 18 and the size of the focusing tube 28. These two sizes change because of wear. Therefore, the optimal abrasive feeding rate must be changed during the cutting process, and this wear can be monitored by indicated changes indicated by the sensor 24. Response to the changes in the sensor can be responded to by either automatic or manual alterations of the abrasive feed rate.

Since the wear of the focusing tube 28 is monitored by sensor 24, the present invention provides the operator with a reliable and quantitative indication of whether the funnel tube 28 meets acceptable standards. In the prior art, the operator has to continually observe the fluid jet stream and using non-quantitative standards and determine when the nozzle fell below the desired standards. The prior art requires skilled operator to function properly.

Yet another application in abrasive fluid jet cutting, cleaning or milling is the detection of the clogging of the funnel tube 28 during the cutting process by injected garnet particles of large dimensions. This clogging quickly becomes apparent by the sensor 24 indications.

The sensor 24 may range in complexity from a visual sensor which has to be observed by the operator to one which sends signals to a microprocessor (not shown, but well known in the art). The microprocessor can be used to stop application of fluid to the nozzle tube 14 when the quality of the fluid stream (as sensed by the sensors 24, 25 or 27) goes below a predetermined limit.

The information from the microprocessor can even be input into an alignment means 33. This assumes that when the quality of the fluid jet decreases, the stream will become wider, and the cutting kerf 34 (width of a workpiece 36 which is cut by the fluid jet 20) will widen.

It follows that for a given indication from the sensor 24, the cutting kerf should have a given dimension. Therefore, the adjustment means can reposition the orientation of the fluid jet nozzle apparatus 10 relative to the workpiece to compensate for the increase in dimension of the fluid jet. It is to be understood that the adjustment means can reposition either the fluid jet nozzle apparatus 10 (see FIG. 3) or the workpiece 36 (see FIG. 4).

While this invention has been illustrated and described in accordance with a preferred embodiment, it is recognized that other variations and changes may be made therein without departing from the invention as set forth in the claims.

Having described the invention, what is claimed is:

1. An apparatus comprising:

a nozzle assembly having a nozzle orifice formed therein;

a highly pressurized fluid source in fluid communication with said nozzle orifice, wherein a fluid jet is discharged through the nozzle orifice into a chamber downstream of said nozzle assembly, the chamber containing entrained air; and a sensor means in fluid communication with the chamber, for sensing a fluid condition of the entrained air contained within said chamber which provides an indication of nozzle orifice quality.

2. The apparatus as described in claim 1, wherein the sensor is a fluid pressure sensor means.

3. The apparatus as described in claim 1, wherein the sensor is a fluid flow meter.

4. The apparatus as described in claim 1, wherein the sensor is both a fluid pressure sensor means and a fluid flow meter.

5. The apparatus as described in claim 1, further comprising abrasive inlet means for introducing abrasive material into the chamber wherein the sensor means is in fluid communication with the abrasive inlet means.

6. An apparatus comprising:

a nozzle assembly having a nozzle orifice formed therein;

a highly pressurized fluid source in fluid communication with said nozzle orifice, wherein a fluid jet is discharged through the nozzle orifice into a chamber downstream of said nozzle assembly, the chamber containing entrained air; and sensor means in fluid communication with the chamber for sensing a fluid condition of the entrained air contained within said chamber which provides an indication of quality of said fluid jet.

7. The apparatus as described in claim 6, further comprising: alignment means for aligning the orientation of the fluid jet relative to the workpiece based upon said indication of the quality of the fluid jet.

8. The apparatus as described in claim 6, wherein the sensor means is a fluid pressure sensor means.

9. The apparatus as described in claim 6, wherein the sensor means is a fluid flow meter.

10. The apparatus as described in claim 6, wherein the sensor means is a combined fluid pressure sensor means and a fluid flow meter.

11. The apparatus as described in claim 6, further comprising abrasive inlet means for introducing abrasive material into the chamber wherein the sensor means is in fluid communication with the abrasive inlet means.

12. An apparatus comprising:

a nozzle assembly having a nozzle orifice formed therein;

a highly pressurized fluid source in fluid communication with said nozzle orifice, wherein a fluid jet is discharged through said nozzle orifice into a chamber downstream of said nozzle assembly, said chamber contains entrained air;

sensor means in fluid communication with said chamber for sensing pressure of entrained air contained within said chamber; and alignment means for aligning orientation of said fluid jet based upon indication of quality of the fluid jet from said sensor means.

13. The apparatus as described in claim 12, wherein said alignment means aligns the orientation of the fluid jet relative to a workpiece based upon said indication of the quality of the fluid jet.

14. The apparatus as described in claim 12, wherein the sensor means is a fluid pressure sensor.

15. The apparatus as described in claim 12, wherein the sensor means is a fluid flow meter.

16. The apparatus as described in claim 12, wherein the sensor means is a combined fluid pressure sensor and a fluid flow meter.

17. The apparatus as described in claim 12, further comprising abrasive inlet means for introducing abrasive material into the chamber wherein the sensor means is in fluid communication with the abrasive inlet means.

* * * * *